United States Patent [19]

Winn

[11] 4,129,350

[45] Dec. 12, 1978

[54] ELECTRIC CORD RECEPTACLE

[76] Inventor: Donald L. Winn, 8641 La Paenda Way, Orangevale, Calif. 95662

[21] Appl. No.: 828,653

[22] Filed: Aug. 29, 1977

[51] Int. Cl.[2] ..... H01R 13/38

[52] U.S. Cl. ..... 339/99 R; 339/184 R

[58] Field of Search ..... 339/97 R, 97 P, 97 L, 339/98, 99, 184 R, 184 M

[56] References Cited

U.S. PATENT DOCUMENTS

| | | | |
|---|---|---|---|
| 1,488,636 | 4/1924 | Geiser | 339/99 R |
| 3,950,063 | 4/1976 | Johansson | 339/97 R |

FOREIGN PATENT DOCUMENTS

| | | | |
|---|---|---|---|
| 587103 | 1/1959 | Italy | 339/99 R |
| 833222 | 4/1960 | United Kingdom | 339/97 P |

*Primary Examiner*—Joseph H. McGlynn
*Attorney, Agent, or Firm*—Daniel Jay Tick

[57] ABSTRACT

A receptacle is affixable to an end of an electric cord. The receptacle has a housing in which the end of the electric cord is inserted. The housing has a hinged cover which may be pressed to a closed position to place cutting contacts in electrical contact with the conductors of the electric cord. The cutting contacts extend from contact strips which are electrically connectible to female plug ferrules. The ferrules accommodate terminal prongs of a utensil. The plug ferrules may be of equal diameter for use with non-polarized utensils. The diameter of one of the ferrules may be larger than the other for use with polarized utensils.

4 Claims, 5 Drawing Figures

ELECTRIC CORD RECEPTACLE

BACKGROUND OF THE INVENTION

The present invention relates to an electric cord receptacle.

The electric cord receptacle of the invention may be used as a replacement part on cords used with television sets, record players, and other appliances, where a female electric cord receptacle is required at the end of the cord. The receptacle of the invention is also usable with electric shavers, electric toothbrushes, calculators, and so on. Furthermore, the electric cord receptacle of the invention permits a damaged electric cord to be repaired without the need for replacing the cord.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
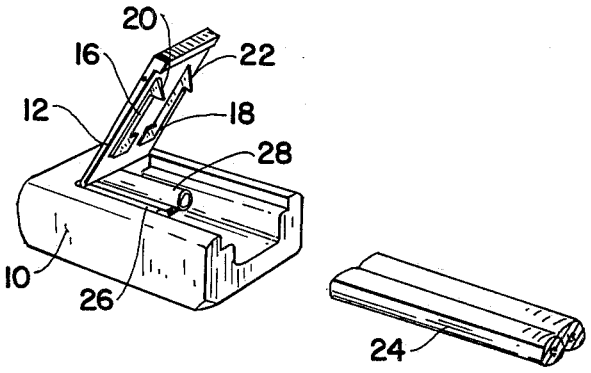
FIG. 1 is a perspective view of an embodiment of the electric cord receptacle of the invention, in unassembled condition.
Figure 2:
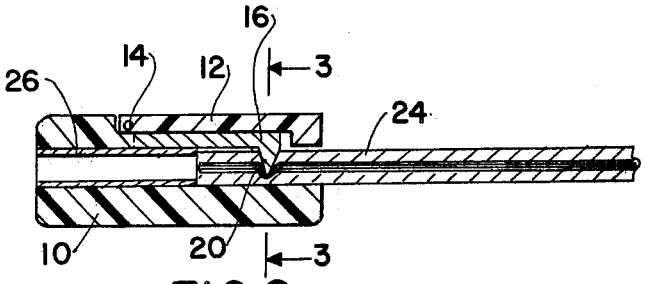
FIG. 2 is a sectional view, on an enlarged scale, of the embodiment of FIG. 1 in assembled condition.

The electric cord receptacle of the invention is for an electric cord 24 having a free end, as shown in FIGS. 1 and 2.

Figure 3:
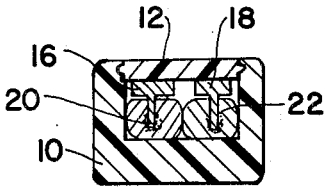
FIG. 3 is a cross-sectional view, taken along the lines 3—3. of FIG. 2.

The electric cord receptacle of the invention comprises a housing 10 (FIGS. 1 to 4). A cover 12 (FIGS. 1 to 3) is hingedly affixed to the housing 10 via a pin 14, as shown in FIG. 2. The cover 12 has an inner surface in the housing 10, when said cover is closed (FIGS. 1 to 3).

Figure 4:
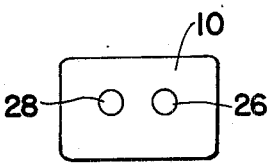
FIG. 4 is an end view of the embodiment of FIGS. 1 to 3.

A pair of female plug ferrules 26 and 28 are mounted in the housing 10, as shown in FIGS. 1 and 4.

Connecting devices connect the free ends of the conductors of the electric cord 24 to the plug ferrules 26 and 28, respectively. The connecting devices comprise a pair of electrically conductive contact strips 16 and 18 affixed to the inner surface of the cover 12 in spaced parallel relation, as shown in FIGS. 1 and 3.

The contact strip 16 has one end positioned to electrically contact the plug ferrule 26 (FIGS. 1 and 2) and a spaced opposite second end having a cutting contact 20 (FIGS. 1 to 3) extending therefrom positioned to electrically contact one of the conductors of the electric cord 24 adjacent the free end thereof. The contact strip 18 has one end positioned to electrically contact the plug ferrule 28 (FIG. 1) and a spaced opposite second end having a cutting contact 22 (FIGS. 1 and 3) extending therefrom positioned to electrically contact the other of the conductors of the electric cord 24 adjacent the free end thereof.

In the embodiment of FIGS. 1 to 4, the female plug ferrules 26 and 28 are equal in diameter, as shown in FIG. 4. This embodiment of the receptacle of the invention is usable with a non-polarized utensil, appliance, device, or the like.

Figure 5:
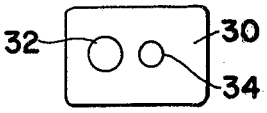
FIG. 5 is an end view of a modification of the embodiment of FIGS. 1 to 3.

In the modification of FIG. 5, one of the female plug ferrules 32 has a diameter greater than that of the other of the female plug ferrules 34. The modification of FIG. 5 of the receptacle of the invention is usable with a polarized utensil, appliance, device, or the like.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An electric cord receptacle for an electric cord having a free end, said electric cord receptacle comprising a housing;

a cover hingedly affixed to the housing via a pin, said cover having an inner surface in the housing when said cover is closed;

a female plug ferrule mounted in the housing; and connecting means for connecting the free end of the electric cord to said plug ferrule, said connecting means comprising an electrically conductive contact strip affixed to the inner surface of said cover, said contact strip having one end positioned to electrically contact said plug ferrule and a spaced opposite second end having a cutting contact extending therefrom positioned to electrically contact the electric cord adjacent the free end thereof.

2. An electric cord receptacle as claimed in claim 1, wherein the electric cord has a plurality of conductors, and further comprising a plurality of female plug ferrules mounted in the housing each electrically connectible to a corresponding one of the conductors of the electric cord.

3. An electric cord receptacle as claimed in claim 2, wherein the female plug ferrules are equal in diameter whereby said receptacle is usable with a non-polarized appliance.

4. An electric cord receptacle as claimed in claim 2, wherein one of the female plug ferrules has a diameter greater than that of the other of the female plug ferrules whereby said receptacle is usable with a polarized appliance.

* * * * *